US009394638B2

(12) United States Patent
Nakamori et al.

(10) Patent No.: US 9,394,638 B2
(45) Date of Patent: Jul. 19, 2016

(54) POLYIMIDE NONWOVEN FABRIC AND PROCESS FOR PRODUCTION THEREOF

(75) Inventors: Masahiko Nakamori, Shiga (JP); Satoshi Maeda, Shiga (JP); Tooru Kitagawa, Shiga (JP); Hisato Kobayashi, Shiga (JP); Yasuo Ohta, Shiga (JP)

(73) Assignee: Toyo Boseki Kabushiki Kaisha, Osaka (JP)

( * ) Notice: Subject to any disclaimer, the term of this patent is extended or adjusted under 35 U.S.C. 154(b) by 1078 days.

(21) Appl. No.: 12/305,722

(22) PCT Filed: Jun. 19, 2007

(86) PCT No.: PCT/JP2007/062277

§ 371 (c)(1),
(2), (4) Date: Dec. 19, 2008

(87) PCT Pub. No.: WO2007/148674

PCT Pub. Date: Dec. 27, 2007

(65) Prior Publication Data

US 2010/0178830 A1 Jul. 15, 2010

(30) Foreign Application Priority Data

Jun. 22, 2006 (JP) ..... 2007-172486

(51) Int. Cl.
*D04H 1/72* (2012.01)
*D04H 3/16* (2006.01)
(Continued)

(52) U.S. Cl.
CPC ..... *D04H 3/16* (2013.01); *D01D 5/0038* (2013.01); *D01F 6/74* (2013.01); *D04H 1/42* (2013.01); *D04H 1/72* (2013.01); *Y10T 442/626* (2015.04)

(58) Field of Classification Search
CPC ..... D01D 5/0038; D01F 6/74
USPC ..... 264/460; 156/244.17
See application file for complete search history.

(56) References Cited

U.S. PATENT DOCUMENTS 3,709,862 A * 1/1973 Minami ..... C08G 73/10 525/436
5,919,892 A * 7/1999 Hwang et al. ..... 528/220
(Continued)

FOREIGN PATENT DOCUMENTS

EP 1911864 A1 4/2008 ..... D01F 6/78
JP 48-1466 1/1973
(Continued)

OTHER PUBLICATIONS

Extended European Search Report, EP App. No. EP 07 74 5497, dated May 14, 2013.

*Primary Examiner* — Jennifer Chriss
*Assistant Examiner* — Camie Thompson
(74) *Attorney, Agent, or Firm* — Fish & Richardson P.C.

(57) ABSTRACT

A non-woven fabric which is excellent in thermal resistance, mechanical strength, and thermal dimensional stability for applications exposed to high temperature circumstance and has an extremely large surface area and exhibit an excellent filter performance is obtained. The non-woven fabric is composed of polyimide fibers which are obtained by polycondensation of at least an aromatic tetracarboxylic acid and an aromatic diamine having a benzoxazole structure and have a fiber diameter in the range of 0.001 μm to 1 μm. The non-woven fabric is obtained by the steps of preparing a polyamic acid by polycondensation of an aromatic tetracarboxylic acid and an aromatic diamine having a benzoxazole structure, and electro-spinning the polyamic acid to form a polyimide precursor non-woven fabric; and imidizing a polyimide precursor fiber bundle.

6 Claims, 1 Drawing Sheet

(51) Int. Cl.

| | |
|---|---|
| ***D01D 5/00*** | (2006.01) |
| ***D01F 6/74*** | (2006.01) |
| ***D04H 1/42*** | (2012.01) |

(56) References Cited

U.S. PATENT DOCUMENTS

| | | | | |
|---|---|---|---|---|
| 2002/0100725 | A1 | 8/2002 | Lee et al. | 210/503 |
| 2004/0166311 | A1* | 8/2004 | Yang et al. | 428/365 |

FOREIGN PATENT DOCUMENTS

| | | | |
|---|---|---|---|
| JP | 63-145465 | | 6/1988 |
| JP | 4-189827 | | 7/1992 |
| JP | 2002-138385 | * | 5/2002 |
| JP | 2002-249966 | | 9/2002 |
| JP | 2003-183966 | * | 7/2003 |
| JP | 2004-308031 | | 11/2004 |
| JP | 2005-19026 | | 1/2005 |

* cited by examiner

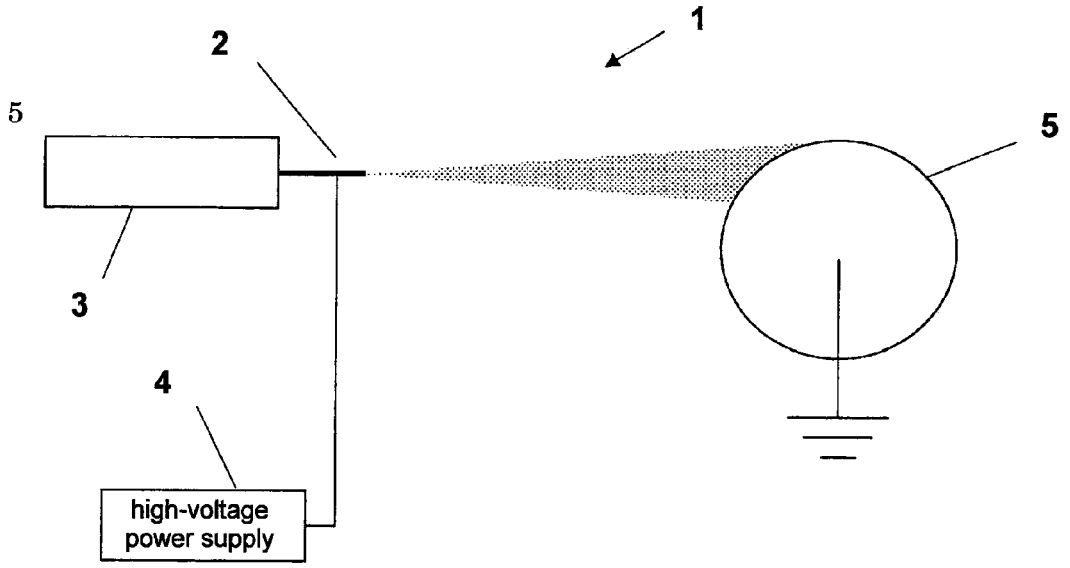
1
2
5
5
3
4
high-voltage
power supply

POLYIMIDE NONWOVEN FABRIC AND PROCESS FOR PRODUCTION THEREOF

CROSS-REFERENCE TO RELATED APPLICATION(S)

This application is a National Stage Application of PCT/JP2007/062277, filed Jun. 19, 2007, which in turn claims the benefit of priority of Japanese patent application No. JP 2006-172486, filed on Jun. 22, 2006.

TECHNICAL FIELD

The present invention relates to a non-woven fabric which is composed of polyimide fibers with a fiber diameter in the range of 0.001 μm to 1 μm and has a low coefficient of linear expansion, and relate to a process for production thereof. Specifically, the present invention relates to a non-woven fabric obtained from a polyimide prepared by polycondensation of at least an aromatic tetracarboxylic acid and an aromatic diamine having a benzoxazole structure.

BACKGROUND ART

Recently, excellent thermal resistance, excellent mechanical properties, and excellent electrical properties are required more than ever in development of organic materials in an electronics field such as a semiconductor, a crystal liquid panel, and a printed wiring board; an environmental field such as a bag filter; a space and aviation field, and the like. For example, in the electronics field, this is because internal devices and batteries therein are reduced in size in accordance with a reduction in size and weight and an increase in wiring density of a mobile phone and a personal computer, resulting in an increased temperature due to internal heat accumulation during use. To solve such a problem, a polyimide resin has been developed and used in various forms such as a membrane, a film, a molded product, a non-woven fabric and a paper in each field. As a new approach, recently, nano-order-sized fibers (nanofibers) of a polyimide with a fiber diameter of 1 μm or less have been examined. As methods for producing an aggregate of fibers with a small fiber diameter, there are a conjugate spinning method, a high-speed spinning method and an electro-spinning method. Among them, the electro-spinning method makes it possible to spin fibers more easily and in a more simple process compared to the other methods. In the electro-spinning method, a liquid (e.g. a solution containing a polymer to form fibers; and a melted polymer) which is charged by applying a high voltage is drawn toward a counter electrode to form fibers. The polymer to form fibers is drawn and forms fibers during drawing toward the counter electrode. The fiber is formed by evaporating a solvent in the case of using a solution containing a polymer which forms fibers, or the fiber is formed by cooling or chemical hardening in the case of using a melted polymer. The obtained fibers is collected on a collecting substrate which is placed according to need, and further, the obtained fibers can be separated therefrom to be used as an aggregate of fibers if required. In addition, since it is possible to directly obtain an aggregate of fibers in the form of a non-woven fabric, there is no need to form an aggregate of fibers after fibers are spun as in the other methods (e.g. refer to Japanese Examined Patent Laid-open Publication No. S48-1466, Japanese Patent Laid-open Publications No. S63-145465 and No. 2002-249966).

As nanofibers using a polyimide resin, it has been proposed a polyamic acid non-woven fabric with an average fiber diameter in the range of 0.001 μm to 1 μm which is obtained by using a thermosetting polyimide comprising a general aromatic tetracarboxylic acid and a general aromatic diamine, and the polyimide non-woven fabric obtained by imidizing the polyamic acid non-woven fabric (Japanese Patent Laid-open Publication No. 2004-308031); and a separator for a lithium secondary battery which is composed of polyimide ultrafine fibers with a fiber diameter of 1 μm or less which is obtained by using a solvent-soluble polyimide (Japanese Patent Laid-open Publication No. 2005-19026). However, they do not sufficiently satisfy thermal dimensional stability such as coefficient of linear expansion required in the fields of use.

DISCLOSURE OF THE INVENTION

Problems to be Solved by the Invention

In order to solve the above problems, it is an object of the present invention to provide a non-woven fabric comprising polyimide fibers with a fiber diameter in the range of 0.001 μm to 1 μm and having a low coefficient of linear expansion. Specifically, it is an objective of the present invention to provide the non-woven fabric obtained from a polyimide which is prepared by polycondensation of at least an aromatic tetracarboxylic acid and an aromatic diamine having a benzoxazole structure and having a low coefficient of linear expansion.

Means for Solving the Problems

The present invention relates to as follows:

1. A non-woven fabric comprising a polyimide obtained by polycondensation of at least an aromatic tetracarboxylic acid and an aromatic diamine having a benzoxazole structure, and having a fiber diameter in the range of 0.001 μm to 1 μm.

2. The non-woven fabric having a coefficient of linear expansion in the range of −6 ppm/° C. to 14 ppm/° C.

3. A process for producing a non-woven fabric comprising the steps of preparing a polyamic acid by polycondensation of an aromatic tetracarboxylic acid and an aromatic diamine having a benzoxazole structure, and electro-spinning the polyamic acid to form a polyimide precursor non-woven fabric; and imidizing a polyimide precursor fiber bundle to obtain the non-woven fabric having a fiber diameter in the range of 0.001 μm to 1 μm.

4. The process for producing the non-woven fabric according to claim 3, wherein the non-woven fabric has a coefficient of linear expansion in the range of −6 ppm/° C. to 14 ppm/° C.

5. The process for producing the non-woven fabric, wherein polyimide precursor fibers are collected on a collecting substrate by electro-spinning which is performed by applying a high voltage to a solution containing a polyimide precursor polymer and an organic solvent as main components.

6. The process for producing the non-woven fabric, wherein polyimide precursor fibers are directly collected and laminated on a support base material to be laminated by electro-spinning which is performed by applying a high voltage to a solution containing a polyimide precursor polymer and an organic solvent as main components.

Effects of the Invention

Since the non-woven fabric obtained by the present invention has an extremely large surface area and is excellent in filter performance, thermal resistance, mechanical properties and thermal dimensional stability, the obtained non-woven fabric is applicable to various air filters such as a bag filter, an air cleaner filter, a filter for a precision apparatus, a cabin filter and an engine filter for automobiles and trains, and an air conditioner filter for buildings. Particularly, the obtained non-woven fabric is effectively used for an air cleaning application which requires thermal resistance, mechanical strength, and thermal dimensional stability; a liquid filter application such as an oil filter; and an electronics application such as an insulating substrate of a light, small, short, and thin electronic circuit and a separator for a secondary battery whose internal temperature rises to high during discharge and charge. More particularly, the non-woven fabric is useful for applications exposed to high temperature circumstance.

BRIEF DESCRIPTION OF THE DRAWING

FIG. 1 is a typical sectional view of an electro-spinning equipment.

EXPLANATION OF REFERENCE NUMBERS

The reference number in the drawing means as follows:

1: an electro-spinning equipment
2: a spinning nozzle
3: a solution vessel
4: a high-voltage power supply
5: a counter electrode

BEST MODE FOR CARRYING OUT THE INVENTION

A polyimide used for polyimide fibers of the present invention is not particularly restricted as long as it is obtained by polycondensation of at least an aromatic tetracarboxylic acid (or anhydride thereof) and an aromatic diamine having a benzoxazole structure. The aromatic diamine and the aromatic tetracarboxylic acid (or anhydride thereof) are subjected to a polyaddition reaction (a ring-opening polyaddition reaction) in a solvent to obtain a solution of a polyamic acid which is a polyimide precursor. Subsequently, a f fiber bundle with a fiber diameter in the range of 0.001 μm to 1 μm is prepared from the polyamic acid solution by electro-spinning or the like, and then the fiber bundle of the polyimide precursor is subjected to drying, thermal treatment, dehydration condensation (imidization), thereby providing a non-woven fabric which is a polyimide fiber bundle.

Examples of the aromatic diamine having the benzoxazole structure which is used for a polyimide benzoxazole include the following compounds.

[Chemical Formula 1]

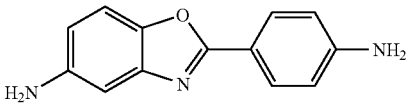

5-amino-2-(p-aminophenyl)benzoxazole

[Chemical Formula 2]

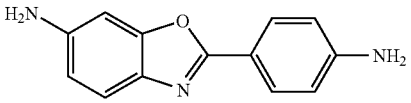

6-amino-2-(p-aminophenyl)benzoxazole

-continued

[Chemical Formula 3]

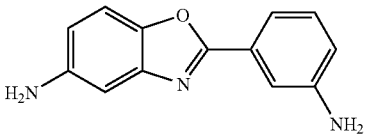

5-amino-2-(m-aminophenyl)benzoxazole

[Chemical Formula 4]

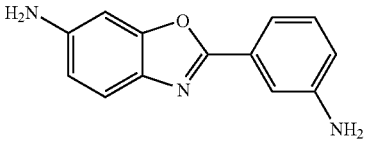

6-amino-2-(m-aminophenyl)benzoxazole

[Chemical Formula 5]

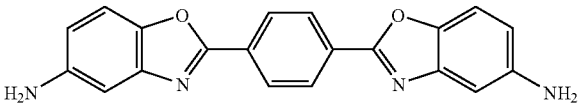

2,2′-P-phenylenebis(5-aminobenzoxazole)

[Chemical Formula 6]

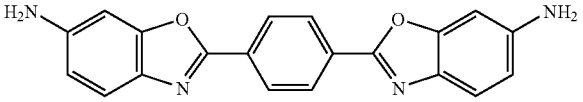

2,2′-P-phenylenebis(6-aminobenzoxazole)

[Chemical Formula 7]

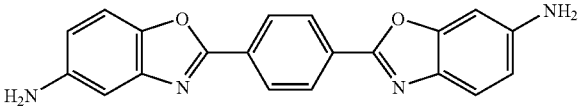

1-(5-aminobenzoxazolo)-4-(6-aminobenzoxazolo)benzene

[Chemical Formula 8]

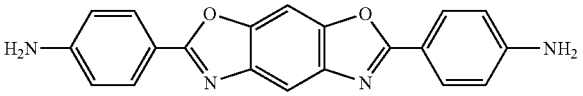

2,6-(4,4′-diaminodiphenyl)benzo[1,2-d:5,4-d′]bisoxazole

[Chemical Formula 9]

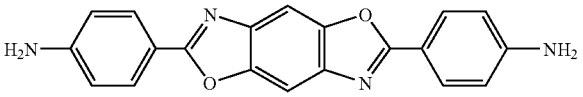

2,6-(4,4′-diaminodiphenyl)benzo[1,2-d:4,5-d′]bisoxazole

[Chemical Formula 10]

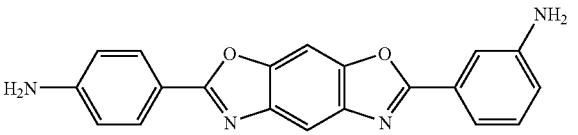

2,6-(3,4′-diaminodiphenyl)benzo[1,2-d:5,4-d′]bisoxazole

-continued

[Chemical Formula 11]

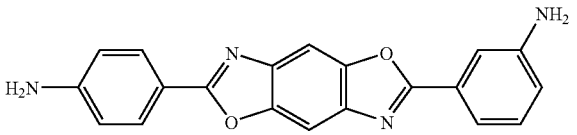

2,6-(3,4′-diaminodiphenyl)benzo[1,2-d:4,5-d′]bisoxazole

[Chemical Formula 12]

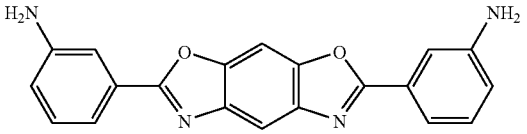

2,6-(3,3′-diaminodiphenyl)benzo[1,2-d:5,4-d′]bisoxazole

[Chemical Formula 13]

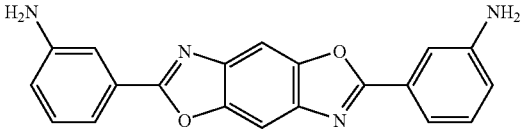

2,6-(3,3′-diaminodiphenyl)benzo[1,2-d:4,5-d′]bisoxazole

Among them, in respect of ease of synthesis, each isomer of amino(aminophenyl)benzoxazole is preferable. Here, the term "each isomer" means each isomer defined by binding positions of the two amino groups in amino(aminophenyl) benzoxazole (e.g. the compounds shown in the above chemical formulas 1 to 4). These diamines may be used alone or as a mixture of at least two of them.

In the present invention, it is preferable that the aromatic diamine having the benzoxazole structure is used in 70 mol % or more.

The present invention is not restricted to the above item, and the following aromatic diamine may be used. Preferably, one or more kinds of the following diamines which do not have the benzoxazole structure are used in combination to obtain the polyimide if the amount of the following diamine is less than 30 mol % of the total aromatic diamines.

Examples of such diamines include 4,4'-bis(3-aminophenoxy)biphenyl, bis[4-(3-aminophenoxy)phenyl]ketone, bis [4-(3-aminophenoxy)phenyl]sulfide, bis[4-(3-aminophenoxy)phenyl]sulfone, 2,2-bis[4-(3-aminophenoxy)phenyl] propane, 2,2-bis[4-(3-aminophenoxy)phenyl]-1,1,1,3,3,3-hexafluoropropane, m-phenylenediamine, o-phenylenediamine, p-phenylenediamine, m-aminobenzylamine, p-aminobenzylamine, 3,3'-diaminodiphenyl ether, 3,4'-diaminodiphenyl ether, 4,4'-diaminodiphenyl ether, 3,3'-diaminodiphenyl sulfide, 3,3'-diaminodiphenyl sulfoxide, 3,4'-diaminodiphenyl sulfoxide, 4,4'-diaminodiphenyl sulfoxide, 3,3'-diaminodiphenyl sulfone, 3,4'-diaminodiphenyl sulfone, 4,4'-diaminodiphenyl sulfone, 3,3'-diaminobenzophenone, 3,4'-diaminobenzophenone, 4,4'-diaminobenzophenone, 3,3'-diaminodiphenylmetane, 3,4'-diaminodiphenylmetane, 4,4'-diaminodiphenylmetane, bis-[4-(4-aminophenoxy)phenyl] methane, 1,1-bis[4-(4-aminophenoxy)phenyl]ethane, 1,2-bis [4-(4-aminophenoxy)phenyl]ethane, 1,1-bis[4-(4-aminophenoxy)phenyl]propane, 1,2-bis[4-(4-aminophenoxy)phenyl]propane, 1,3-bis[4-(4-aminophenoxy)phenyl]propane, 2,2-bis[4-(4-aminophenoxy)phenyl]propane, 1,1-bis[4-(4-aminophenoxy)phenyl]butane, 1,3-bis[4-(4-aminophenoxy)phenyl]butane, 1,4-bis[4-(4-aminophenoxy) phenyl]butane, 2,2-bis[4-(4-aminophenoxy)phenyl]butane, 2,3-bis[4-(4-aminophenoxy)phenyl]butane, 2-[4-(4-aminophenoxy)phenyl]-2-[4-(4-aminophenoxy)-3-methyl phenyl]propane, 2,2-bis[4-(4-aminophenoxy)-3-methylphenyl] propane, 2-[4-(4-aminophenoxy)phenyl]-2-[4-(4-aminophenoxy)-3,5-dimethylphenyl]propane, 2,2-bis[4-(4-aminophenoxy)-3,5-dimethylphenyl]propane, 2,2-bis[4-(4-aminophenoxy)phenyl]-1,1,1,3,3,3-hexafluoropropane, 1,4-bis(3-aminophenoxy)benzene, 1,3-bis(3-aminophenoxy)benzene, 1,4-bis(4-aminophenoxy)benzene, 4,4'-bis(4-aminophenoxy)biphenyl, bis[4-(4-aminophenoxy)phenyl] ketone, bis[4-(4-aminophenoxy)phenyl]sulfide, bis[4-(4-aminophenoxy)phenyl]sulfoxide, bis[4-(4-aminophenoxy) phenyl]sulfone, bis[4-(3-aminophenoxy)phenyl]ether, bis[4-(4-aminophenoxy)phenyl]ether, 1,3-bis[4-(4-aminophenoxy)benzoyl]benzene, 1,3-bis[4-(3-aminophenoxy)benzoyl]benzene, 1,4-bis[4-(3-aminophenoxy)benzoyl]benzene, 4,4'-bis[(3-aminophenoxy)benzoyl]benzene, 1,1-bis[4-(3-aminophenoxy)phenyl]propane, 1,3-bis[4-(3-aminophenoxy)phenyl]propane, 3,4'-diaminodiphenylsulfide, 2,2-bis[3-(3-aminophenoxy)phenyl]-1,1,1,3,3,3-hexafluoropropane, bis[4-(3-aminophenoxy)phenyl]methane, 1,1-bis[4-(3-aminophenoxy)phenyl]ethane, 1,2-bis[4-(3-aminophenoxy)phenyl]ethane, bis[4-(3-aminophenoxy) phenyl]sulfoxide, 4,4'-bis[3-(4-aminophenoxy)benzoyl] diphenyl ether, 4,4'-bis[3-(3-aminophenoxy)benzoyl] diphenyl ether, 4,4'-bis[4-(4-amino-α,α-dimethylbenzyl) phenoxy]benzophenone, 4,4'-bis[4-(4-amino-α,α-dimethylbenzyl)phenoxy]diphenyl sulfone, bis[4-{4-(4-aminophenoxy)phenoxy}phenyl]sulfone, 1,4-bis[4-(4-aminophenoxy)phenoxy-α,α-dimethylbenzyl]benzene, 1,3-bis[4-(4-aminophenoxy)phenoxy-α,α-dimethylbenzyl] benzene, 1,3-bis[4-(4-amino-6-trifluoromethylphenoxy)-α,α-dimethylbenzyl]benzene, 1,3-bis[4-(4-amino-6-fluorophenoxy)-α,α-dimethylbenzyl]benzene, 1,3-bis[4-(4-amino-6-methylphenoxy)-α,α-dimethylbenzyl]benzene, 1,3-bis[4-(4-amino-6-cyanophenoxy)-α,α-dimethylbenzyl] benzene, 3,3'-diamino-4,4'-diphenoxybenzophenone, 4,4'-diamino-5,5'-diphenoxybenzophenone, 3,4'-diamino-4,5'-diphenoxybenzophenone, 3,3'-diamino-4-phenoxybenzophenone, 4,4'-diamino-5-phenoxybenzophenone, 3,4'-diamino-4-phenoxybenzophenone, 3,4'-diamino-5'-phenoxybenzophenone, 3,3'-diamino-4,4'-dibiphenoxybenzophenone, 4,4'-diamino-5,5'-dibiphenoxybenzophenone, 3,4'-diamino-4,5'-dibiphenoxybenzophenone, 3,3'-diamino-4-biphenoxybenzophenone, 4,4'-diamino-5-biphenoxybenzophenone, 3,4'-diamino-4-biphenoxybenzophenone, 3,4'-diamino-5'-biphenoxybenzophenone, 1,3-bis(3-amino-4-phenoxybenzoyl)benzene, 1,4-bis(3-amino-4-phenoxybenzoyl)benzene, 1,3-bis(4-amino-5-phenoxybenzoyl)benzene, 1,4-bis(4-amino-5-phenoxybenzoyl)benzene, 1,3-bis(3-amino-4-biphenoxybenzoyl)benzene, 1,4-bis(3-amino-4-biphenoxybenzoyl)benzene, 1,3-bis(4-amino5-biphenoxybenzoyl)benzene, 1,4-bis(4-amino-5-biphenoxybenzoyl)benzene, 2,6-bis[4-(4-amino-α,α-dimethylbenzyl)phenoxy]benzonitrile, aromatic diamines in which a part or all of hydrogen atoms on the aromatic ring of the above aromatic diamines is substituted with a halogen atom, an alkyl group or an alkoxyl group having a carbon number of 1 to 3, a cyano group, or a halogenated alkyl group or a halogenated alkoxyl group having a carbon number of 1 to 3 obtained by substituting a part or all of hydrogen atoms in an alkyl group or an alkoxyl group with halogen atoms, and the like.

Examples of the aromatic tetracarboxylic acid used in the present invention include an aromatic tetracarboxylic anhydride. Specifically, examples of the aromatic tetracarboxylic anhydride include the following compounds.

[Chemical Formula 14]

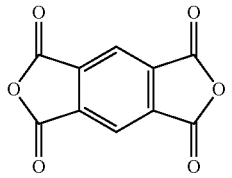

Pyromellitic anhydride

[Chemical Formula 15]

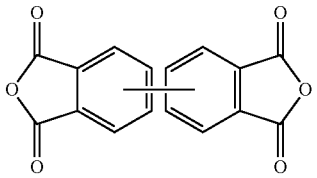

3,3′,4,4′-biphenyltetracarboxylic anhydride

[Chemical Formula 16]

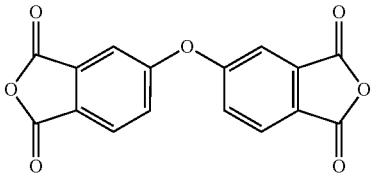

4,4′-oxydiphthalic anhydride

[Chemical Formula 17]

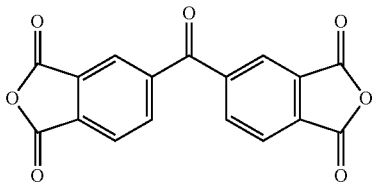

3,3′,4,4′-benzophenonetetracarboxylic anhydride

[Chemical Formula 18]

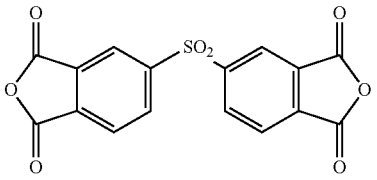

3,3′,4,4′-diphenylsulfonetetracarboxylic anhydride

[Chemical Formula 19]

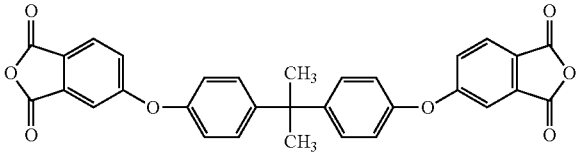

2,2′-bis[4-(3,4-dicarboxyphenoxy)phenyl]propanoic anhydride

These tetracarboxylic dianhydrides may be used alone or as a mixture of at least two of them.

In the present invention, one or more kinds of the following nonaromatic tetracarboxylic dianhydrides may used in combination if the amount of the following nonaromatic tetracarboxylic dianhydride is less than 30 mol % of the total tetracarboxylic dianhydrides. Examples of such tetracarboxylic anhydrides include butane-1,2,3,4-tetracarboxylic dianhydride, pentane-1,2,4,5-tetracarboxylic dianhydride, cyclobutanetetracarboxylic dianhydride, cyclopentane-1,2,3,4-tetracarboxylic dianhydride, cyclohexane-1,2,4,5-tetracarboxylic dianhydride, cyclohexa-1-ene-2,3,5,6-tetracarboxylic dianhydride, 3-ethylcyclohexa-1-ene-3-(1,2), 5,6-tetracarboxylic dianhydride, 1-methyl-3-ethylcyclohexane-3-(1,2), 5,6-tetracarboxylic dianhydride, 1-methyl-3-ethylcyclohexa-1-ene-3-(1,2), 5,6-tetracarboxylic dianhydride, 1-ethylcyclohexane-1-(1,2), 3,4-tetracarboxylic dianhydride, 1-propylcyclohexane-1-(2,3), 3,4-tetracarboxylic dianhydride, 1,3-dipropylcyclohexane-1-(2,3), 3-(2,3)-tetracarboxylic dianhydride, dicyclohexyl-3,4,3',4'-tetracarboxylic dianhydride bicyclo[2.2.1]heptane-2,3,5,6-tetracarboxylic dianhydride, 1-propylcyclohexane-1-(2,3), 3,4-tetracarboxylic dianhydride, 1,3-dipropylcyclohexane-1-(2,3), 3-(2,3)-tetracarboxylic dianhydride, dicyclohexyl-3,4,3',4'-tetracarboxylic dianhydride, bicyclo[2.2.1]heptane-2,3,5,6-tetracarboxylic dianhydride, bicyclo[2.2.2]octane-2,3,5,6-tetracarboxylic dianhydride, bicyclo[2.2.2]oct-7-ene-2,3,5,6-tetracarboxylic dianhydride and the like. These tetracarboxylic dianhydrides may be used alone or as a mixture of at least two of them.

The solvent used to obtain the polyamic acid by polycondensation (polymerization) of the aromatic diamine and the aromatic tetracarboxylic acid (or anhydride thereof) is not particularly restricted as long as it dissolves monomers as raw materials and the produced polyamic acid; however, a polar organic solvent is preferable. The examples of the solvent include N-methly-2-pyrrolidone, N-acetyl-2-pyrrolidone, N,N-dimethylformamide, N,N-diethylformamide, N,N-dimethylacetamide, dimethylsulfoxide, hexamethylphosphoricamide, ethyl cellosolve acetate, diethylene glycol dimethyl ether, sulfolane, halogenated phenols and the like. These solvents may be used alone or as a mixture of them. The used amount of the solvent is not limited as long as the solvent sufficiently dissolves monomers as raw materials. Specifically, for example, the solvent may be used as the amount of the monomers in the solution which dissolves the monomers is normally 5 mass % to 40 mass % and preferably 10 mass % to 30 mass %.

The condition of the polymerization reaction for obtaining the polyamic acid (hereinafter, referred to merely as "polymerization reaction") may be applied a conventionally-known condition. Specifically, for example, the polymerization reaction may be conducted by stirring and/or blending in the organic solvent at a temperature in the range of 0° C. to 80° C. for 10 minutes to 30 hours continuously. According to need, the polymerization reaction may be divided, and the temperature may be raised or lowered. In this case, the adding order of both monomers is not particularly limited to a specific order; however, it is preferable that the aromatic tetracarboxylic anhydride is added to the solution of the aromatic diamine. The polyamic acid solution obtained by the polymerization reaction preferably contains the polyamic acid in an amount of 5 mass % to 40 mass %, and more preferably 10 mass % to 30 mass %. The viscosity of the solution which is measured with a Brookfield viscometer (25° C.) is preferably in the range of 10 Pa·s to 2000 Pa·s, and more preferably 100 Pa·s to 1000 Pa·s in respect of stability in transferring the solution.

In the present invention, the reduced viscosity (ηsp/C) of the polyamic acid is not particularly limited; however, it is preferably 3.0 dl/g or more, and more preferably 3.5 dl/g or more.

Vacuum-defoaming during the polymerization reaction is effective for preparing the high-quality organic solvent solution of the polyamic acid. Also, prior to the polymerization reaction, a small amount of a terminal sealing agent may be added to the aromatic diamine to control polymerization. Examples of the terminal sealing agent include a compound having a carbon-carbon double bond such as maleic anhydride. When maleic anhydride is used, the used amount of maleic acid is preferably in the range of 0.001 mol to 1.0 mol per 1 mol of the aromatic diamine.

As an imidization method by a high-temperature treatment, a conventionally-known imidization reaction can be applied as appropriate. Examples of the imidization method include a method in which the polyamic acid solution without a ring-closure catalyst and a dehydrating agent is subjected to a heating treatment to proceed the imidization reaction (so called thermal ring-closure method), and a chemical ring-closure method in which a ring-closure catalyst and a dehydrating agent are added to the polyamic acid solution and the imidization reaction is proceeded by the working of the ring-closure catalyst and the dehydrating agent.

In the thermal ring-closure method, the maximum heating temperature is, for example, in the range of 100° C. to 500° C., and preferably 200° C. to 480° C. If the maximum heating temperature is lower than this range, ring-closing may not be proceeded enough. On the other hand, if the maximum heating temperature is higher than this range, deterioration may be progressed, resulting in becoming brittle of a composite material. As a preferable embodiment, for example, a two-step treatment is shown, in which the treatment is conducted at a temperature in the range of 150° C. to 250° C. for 3 minutes to 20 minutes and then at a temperature in the range of 350° C. to 500° C. for 3 minutes to 20 minutes.

In the chemical ring-closure method, after the imidization reaction is partially proceeded in the polyamic acid solution to form the polyimide precursor having a self-supporting property, imidization can be fully conducted by heating.

In this case, as a condition for partially proceeding the imidization reaction, a thermal treatment is preferably conducted at a temperature in the range of 100° C. to 200° C. for 3 minutes to 20 minutes; and as a condition for fullying conducting the imidization reaction, a thermal treatment is preferably conducted at a temperature in the range of 200° C. to 400° C. for 3 minutes to 20 minutes.

The timing of adding the ring-closure catalyst to the polyamic acid solution is not particularly restricted; and the ring-closure catalyst may be added in advance prior to the polymerization reaction for obtaining the polyamic acid. Examples of the ring-closure catalyst include an aliphatic tertiary amine such as trimethylamine and triethylamine; and a heterocyclic tertiary amine such as isoquinoline, pyridine, and β-picoline. Among them, at least one selected from the heterocyclic tertiary amines is preferable. The used amount of the ring-closure catalyst per 1 mol of the polyamic acid is not particularly limited; however it is preferable in the range of 0.5 mol to 8 mol. The timing of adding the dehydrating agent to the polyamic acid solution is not particularly restricted; and the dehydrating agent may be added in advance prior to the polymerization reaction for obtaining the polyamic acid. Examples of the dehydrating agent include an aliphatic carboxylic anhydrid such as acetic anhydride, propionic anhydride, and butyric anhydride; an aromatic carboxylic anhydride such as benzoic anhydride. Among them, acetic anhydride, benzoic anhydride, and the mixture thereof are preferable. The used amount of the dehydrating agent per 1 mol of the polyamic acid is not particularly limited; however it is preferable in the range of 0.1 mol to 4 mol. When the dehydrating agent is used, a gelling retarder such as acetylacetone may be used in combination.

In the present invention, in order to improve various properties of the non-woven fabric obtained by electro-spinning, an additive such as an inorganic or organic filler may be blended. When the additive has a low affinity for the polyamic acid, it is preferable that the size of the additive is smaller than the diameter of obtained polyamic acid fibers. If the size of the additive is lager than the diameter of the obtained polyamic acid fibers, the additive may deposit during electro-spinning, resulting in breaking fibers. Examples of a method for blending the additive include a method in which a required amount of the additive is added in advance to the reaction solution of the polyamic acid polymerization; and a method in which a required amount of the additive is added after the polymerization reaction of the polyamic acid is conducted. In the case that the additive does not inhibit the polymerization, the former method is preferable because the non-woven fabric in which the additive is dispersed more uniformly is obtained. In the case that the required amount of the additive is added after the polymerization reaction of the polyamic acid is conducted, stirring by ultrasonic waves or mechanical stirring by a homogenizer or the like are introduced. The non-woven fabric of the polyamic acid the present invention is formed of fibers having an average fiber diameter in the range of 0.001 μm to 1 μm. If the average fiber diameter is smaller than 0.001 μm, it is not preferable since the self-supporting property of the fibers is insufficient. On the other hand, if the average fiber diameter is larger than 1 μm, it is not preferable since the surface area of the fibers become small. A preferable average fiber diameter is in the range of 0.01 μm to 0.5 μm. For example, the average fiber diameter is more preferably in the range of 0.001 μm to 0.3 μm for the use of an air filter application. As the fiber diameter becomes smaller, a higher filtering efficiency is obtained, which is preferable. Particularly, if the fiber diameter is less than 0.5 μm, it is more preferable because a slip flow effect which decreases airflow resistance compared to a normal non-woven fabric filter is obtained. If the fiber diameter is less than 0.001 μm, the strength of the non-woven fabric decreases and the handleability of the non-woven fabric deteriorates due to fluffing.

A process for producing the polyimide non-woven fabric of the present invention is not particularly restricted as long as it is the method that a fiber having a fiber diameter in the range of from 0.001 μm to 1 μm is obtained; however, an electro-spinning method is preferable. Hereinafter, a producing process by the electro-spinning method is described.

The electro-spinning method used in the present invention is one type of a solution spinning method, in which a fiber is formed during a process where a polymer solution of high plus voltage applied is sprayed to the surface of an earthed or negatively charged electrode generally. An example of an electro-spinning equipment is shown in FIG. 1. In the FIGURE, the electro-spinning equipment 1 is provided with a spinning nozzle 2 that discharges a polymer, a raw material of the fiber, and a counter electrode 5 facing to the spinning nozzle 2. This counter electrode 5 is earthed. The polymer solution which is charged by application of high voltage is discharged from the spinning nozzle 2 towards the counter electrode 5, during which a fiber is formed. A solution prepared by dissolving polyimide in an organic solvent is discharged in an electrostatic field formed between electrodes, and the solution is drawn towards the counter electrode to accumulate the formed fibrous substance on a collecting substrate, whereby a non-woven fabric can be obtained. Here, the term non-woven fabric includes not only a non-woven fabric in which the solvent in the solution has been already removed, but also a non-woven fabric containing the solvent of the solution.

In the case of the non-woven fabric containing the solvent, the solvent is removed after the electro-spinning. Examples of the method for removing the solvent include the method that the non-woven fabric is immersed in a poor solvent to extract the solvent and the method that the residual solvent is vaporized by a heat treatment.

A material of a solution vessel 3 is not particularly restricted as long as it has resistance to the organic solvent to be used. Also, the solution in the solution vessel 3 may be discharged in the electric field by a method of mechanically extraction, pumping out or the like.

The spinning nozzle 2 has preferably an inside diameter in the range of from about 0.1 mm to about 3 mm. A material of the nozzle may be either a metal or a nonmetal. When the nozzle is made of a metal, the nozzle may be used as one electrode. When the nozzle 2 is made of a nonmetal, an electric field may be impressed on the discharged solution by installing the electrode inside of the nozzle. A plurality of nozzles may be used considering production efficiency. In addition, though the cross-section shape of the nozzle is generally circular, a nozzle having a modified cross-section shape may be used according to the kind of polymer and a use application.

With regard to the counter electrode 5, an electrode having various shapes such as a roll-like electrode as shown in FIG. 1, or plate-like or belt-like metallic electrode may be used according to a use application.

Though the case that the counter electrode 5 serves as the substrate to collect fibers is explained in the above description, a substance that serves as the collecting substrate may be installed between the electrodes to collect polyimide fibers thereon. In this case, for example, a belt substrate is installed between the electrodes, thereby enabling continuous production.

Though the electrodes are generally formed in pairs, an additional electrode may be introduced. Fibers are spun by the pair of electrodes, and further, the introduced electrode of different electric potential is used to control the state of the electric field, thereby controlling the condition of the fiber spinning.

A high-voltage power supply 4 is not restricted particularly, and a direct-current high-voltage generator may be used and also a Van de Graaff electrostatic generator may be used. Though the applied voltage is not limited particularly, the applied voltage is generally in the range of 3 kV to 100 kV, preferably in the range of 5 kV to 50 kV and more preferably in the range of 5 kV to 30 kV. The polarity of the applied voltage may be either positive or negative.

The distance between the electrodes is dependent on, for example, charge amount, the size of the nozzle, the discharging amount of the solution for spinning (the spinning solution), the concentration of the spinning solution, and the like. The distance between the electrodes is appropriately in the range of 5 cm to 20 cm when the applied voltage is in the range of 10 kV to 15 kV.

With regard to an atmosphere of the fiber spinning, the fiber spinning is usually performed in air. However, the electro-spinning may be also performed in a gas, such as carbon dioxide, having a higher sparkover voltage than air, which enables spinning at a low voltage and also makes it possible to prevent abnormal electrical discharge such as a corona discharge. Also, when water is a poor solvent which scarcely solve polyimide, polyimide may precipitate in the proximity of the spinning nozzle. Therefore, it is preferable to perform fiber spinning in air which is allowed to pass through a drying unit to reduce water content in air.

Next, the step for obtaining the non-woven fabric of the present invention accumulated on the collecting substrate is described. In the present invention, during drawing the solution towards the collecting substrate, a fibrous substance is formed by a solvent vaporization on a condition. At usual room temperature, the solvent is vaporized completely before the fibrous substance is collected on the collecting substrate, however, in the case that the solvent is insufficiently vaporized, the fiber drawing may be performed under reduced pressure. The fiber of the present invention has been formed by the time when the fibrous substance is collected on the collecting substrate at the latest. The fiber drawing temperature is usually at the range of 0° C. to 50° C. though it depends on the state of the solvent vaporization and on the viscosity of the fiber spinning solution. Then, porous fibers are accumulated on the collecting substrate to thereby produce the non-woven fabric.

Though the basis weight of the non-woven fabric of the present invention is determined according to its use application and is not limited particularly, it is preferably in the range of 1 $g/m^2$ to 50 $g/m^2$. The basis weight is measured according to JIS-L1085.

Though the basis weight of the non-woven fabric of the present invention is determined according to its use application and is not limited particularly, it is preferably in the range of 0.05 $g/m^2$ to 50 $g/m^2$ in an air filter application. The basis weight is measured according to JIS-L1085. When the basis weight is 0.05 $g/m^2$ or less, it is unfavorable because the collecting efficiency of the filter is lowered, whereas when the basis weight is 50 $g/m^2$ or more, it is unfavorable because an airflow resistance of the filter is too high.

Though the thickness of the non-woven fabric of the present invention is determined according to its use application and is not limited particularly, it is preferably in the range of 1 μm to 100 μm in the air filter application. The thickness is measured by a micrometer.

The non-woven fabric of the present invention may be used singly or in combination of other members according to handleability and a use application. For example, cloth (a non-woven fabric, a woven fabric or a knit fabric) that can be a support base material as the collecting substrate, conductive materials made of metals, carbon or the like having a film, drum, net, plate or belt form, and nonconductive materials made of organic polymers may be used. By forming the non-woven fabric on these members, the member that the support base material is combined with the non-woven fabric can be manufactured.

As the cloth which can be used as the above support base material, a non-woven fabric is most preferably used from economic point of view. The fiber diameter of fibers constituting the non-woven fabric of the support base material is preferably larger than that of the non-woven fabric of the present invention which has been subjected to the charge treatment. The non-woven fabric of the support base material is useful for enhancing the strength of the filter to prevent deformation. For the above purpose, the fiber diameter of the fibers constituting the non-woven fabric of the support base material is preferably 1.5 times or more, more preferably 2 times or more, and particularly preferably 5 times or more than that of the non-woven fabric of the present invention which has been subjected to the charge treatment. If the fiber diameter is 500 times or more than that of the non-woven fabric of the present invention, it may be difficult to join both the non-woven fabrics.

The coefficient of linear expansion of the polyimide fiber non-woven fabric of the present invention is measured as follows.

<Measurement of Coefficient of Linear Expansion (CTE)>

The expansion ratio of an object to be measured is measured under the following conditions, and the expansion ratio/temperature is measured between intervals of 10° C., for example from 90° C. to 100° C., and from 100° C. to 110° C. This measurement is conducted up to 400° C. and the average of all the measured values in the range of from 100° C. to 350° C. is calculated as a coefficient of linear expansion (average value).

Apparatus: TMA4000S available from MAC Science Co.
Sample length: 10 mm
Sample width: 2 mm
Temperature-rising start temperature: 25° C.
Temperature-rising end temperature: 400° C.
Temperature-rising rate: 5° C./min
Atmosphere: argon The coefficient of linear expansion of the polyimide fiber non-woven fabric is essentially in the range of −6 ppm/° C. to 14 ppm/° C., preferably −5 ppm/° C. to 10 ppm/° C., and more preferably −5 ppm/° C. to 5 ppm/° C. This property enhances thermal dimensional stability under high temperature and greatly affects prevention of detachment, for example, in a layered product including a metallic layer.

EXAMPLES

The present invention is hereinafter described by way of Examples; however, the present invention is not limited to these Examples. Evaluation items for each Example were conducted as the following method.

<Reduced Viscosity ηsp/C of the Polyamic Acid>

A solution prepared by dissolving in N-methyl-2-pyrrolidone in a polymer concentration of 0.2 g/dl was maintained at 30° C., and a reduced viscosity was measured with an Ubbelohde viscosity tube.

<Average Fiber Diameter>

A scanning electronic microphotograph (magnification: 5000 times) of the surface of the obtained non-woven fabric was taken. The diameter of the fiber was measured from the photograph, and the number average value of 10 samples was calculated.

Reference Example 1

Preparation of a Polyamic Acid Solution

A liquid-contactable portion in a reaction container equipped with a nitrogen introduction tube, a thermometer and a stirrer and the inside of the reaction contained with transport tube made of an austenite stainless steel, SUS316L, was filled with nitrogen gas. Subsequently, 223 mass parts of 5-amino-2-(p-aminophenyl)benzoxazole and 4448 mass parts of N,N-dimethylacetamide were added and completely dissolved, and then, 217 mass parts of pyromellitic dianhydride was added. The solution was stirred at 25° C. for 24 hours, resulting in producing a brown and viscous polyamic acid solution A1. The reduced viscosity (ηsp/C) of the polyamic acid solution A1 was 4.0 dl/g.

Reference Example 2

Preparation of a Polyamic Acid Solution

A liquid-contactable portion in a reaction container equipped with a nitrogen introduction tube, a thermometer and a stirrer and the inside of the reaction contained with transport tube made of an austenite stainless steel, SUS316L, was filled with nitrogen gas. Subsequently, 200 mass parts of diaminodiphenyl ether was put therein. Then, after 4202 mass parts of N-methly-2-pyrrolidone was added and completely dissolved, 217 mass parts of pyromellitic dianhydride was added. The solution was stirred at 25° C. for 5 hours, resulting in producing a brown and viscous polyamic acid solution B. The reduced viscosity (ηsp/C) of the polyamic acid solution B was 3.7 dl/g.

Reference Example 3

Preparation of a Polyamic Acid Solution

A liquid-contactable portion in a reaction container equipped with a nitrogen introduction tube, a thermometer and a stirrer and the inside of the reaction contained with transport tube made of an austenite stainless steel, SUS316L, was filled with nitrogen gas. Subsequently, 108 mass parts of phenylenediamine was put therein. Then, after 4042 mass parts of N-methly-2-pyrrolidone was added and completely dissolved, 292.5 mass parts of diphenyltetracarboxylic dianhydride was added. The solution was stirred at 25° C. for 12 hours, resulting in producing a brown and viscous polyamic acid solution C. The reduced viscosity (ηsp/C) of the polyamic acid solution C was 4.5 dl/g.

(Producing of a Non-Woven Fabric)

The polyamic acid solutions indicated in the Reference Examples were discharged to the collection electrode 5 for collecting a fibrous material for 30 minutes by using the equipment shown in FIG. 1.

The obtained fiber bundle was subjected to a continuous furnace filled with nitrogen gas to be heated at high temperature by two-step heating, that is a first step heating and a second step heating, thereby proceeding an imidization reaction. Subsequently, the fiber bundle was cooled to room temperature for 5 minutes to obtain a brown polyimide non-woven fabric of each Example.

The average fiber diameters, the coefficients of linear expansion, and the like, of the obtained fiber bundles (non-woven fabrics) are shown in Table 1.

TABLE 1

| Item | | Example 1 | Comparative Example 1 |
|---|---|---|---|
| Polyamic acid solution | | Reference example 1 | Reference example 2 |
| Fiber diameter | μm | 100 | 102 |
| CTE | ppm/° C. | 5 | 25 |

INDUSTRIAL APPLICABILITY

The polyimide non-woven fabric of the present invention is prepared from the polyimide obtained by polycondensation of at least the aromatic tetracarboxylic acid and the aromatic diamine having the benzoxazole structure, and has the coefficient of linear expansion in the range of −6 ppm/° C. to +14 ppm/° C. and is excellent in thermal dimensional stability. The non-woven fabric can be effectively used for an air filter application such a bag filter, an air cleaner filter, a filter for a precision apparatus, a cabin filter and an engine filter for automobiles and trains, and an air conditioner filter for buildings; a liquid filter application such as an oil filter; and an electronics application such as an insulating substrate of a light, small, short, and thin electronic circuit and a separator for a secondary battery whose internal temperature rises to high during discharge and charge. More particularly, the non-woven fabric is useful for applications exposed to high temperature circumstance, and extremely industrially valuable.

What is claimed is:

1. A process for producing a non-woven fabric, comprising the steps of:

preparing a polyamic acid by polycondensation of reactants consisting of an aromatic tetracarboxylic acid anhydride and an aromatic diamine having a benzoxazole structure in one or more organic solvents, and electro-spinning the polyamic acid to form a polyimide precursor fiber bundle; and imidizing the polyimide precursor fiber bundle to obtain the non-woven fabric having a fiber diameter in the range of 0.001 μm to 100 nm and having a coefficient of linear expansion in the range of −6 ppm/° C. to 14 ppm/° C.;

wherein the aromatic tetracarboxylic acid anhydride is selected from the group consisting of pyromellitic anhydride, 3,3',4,4'-biphenyltetracarboxylic anhydride, 4,4'-oxydiphthalic anhydride, 3,3',4,4'-benzophenonetetracarboxylic anhydride, 3,3',4,4'-diphenylsulfonetetracarboxylic anhydride, and 2,2'-bis[4-(3,4-dicarboxyphenoxy)phenyl]propanoic anhydride, the aromatic diamine is selected from the group consisting of:

5-amino-2-(p-aminophenyl)benzoxazole, 6-amino-2-(p-aminophenyl)benzoxazole, 5-amino-2-(m-aminophenyl)benzoxazole, 6-amino-2-(m-aminophenyl)benzoxazole, 2,2'-p-phenylenebis(5-aminobenzoxazole), 2,2'-p-phenylenebis(6-aminobenzoxazole), 1-(5-aminobenzoxazolo)-4-(6-aminobenzoxazole)benzene, 2,6-(4,4'-diaminodiphenyl)benzo[1,2-d:5,4-d']bisoxazole, 2,6-(4,4'-diaminodiphenyl)benzo[1,2-d:4,5-d']bisoxazole, 2,6-(3,4'-diaminodiphenyl)benzo[1,2-d:5,4-d']bisoxazole, 2,6-(3,4'-diaminodiphenyl)benzo[1,2-d:4,5-d']bisoxazole, 2,6-(3,3'-diaminodiphenyl)benzo[1,2-d:5,4-d']bisoxazole, and 2,6-(3,3'-diaminodiphenyl)benzo[1,2-d:4,5-d']bisoxazole, the polyamic acid has a reduced viscosity of 3.0 dl/g or more, and the electro-spinning is carried out under the following conditions:

the spinning nozzle has an inside diameter in the range of from 0.1 mm to 3 mm, the applied voltage is in the range of 10 kV to 15 kV, and the distance between the electrodes is in the range of 5 cm to 20 cm.

2. The process for producing the non-woven fabric according to claim 1, wherein polyimide precursor fibers are collected on a collecting substrate by electro-spinning which is performed by applying a high voltage to a solution containing a polyimide precursor polymer and an organic solvent as main components.

3. The process for producing the non-woven fabric according to claim 1, wherein polyimide precursor fibers are directly collected and laminated on a support base material to be laminated by electro-spinning which is performed by applying a high voltage to a solution containing a polyimide precursor polymer and an organic solvent as main components.

4. The process for producing the non-woven fabric according to claim 1, wherein the polyimide precursor fiber bundle is formed by collecting polyimide precursor fibers on a collecting substrate by electro-spinning which is performed by applying a high voltage to a solution containing a polyimide precursor polymer and an organic solvent as main components.

5. The process for producing the non-woven fabric according to claim 1, wherein the polyimide precursor fiber bundle is formed by collecting and laminating polyimide precursor fibers directly on a support base material to be laminated by electro-spinning which is performed by applying a high voltage to a solution containing a polyimide precursor polymer and an organic solvent as main components.

6. The process for producing the non-woven fabric according to claim 1, wherein the basis weight of the non-woven fabric is in the range of 1 $g/m^2$ to 50 $g/m^2$.

* * * * *